US007654469B2

(12) United States Patent
Boehland et al.

(10) Patent No.: US 7,654,469 B2
(45) Date of Patent: Feb. 2, 2010

(54) FUEL INJECTION SYSTEM FOR AN INTERNAL COMBUSTION ENGINE

(75) Inventors: Peter Boehland, Marbach (DE); Godehard Nentwig, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 399 days.

(21) Appl. No.: 11/387,777

(22) Filed: Mar. 24, 2006

(65) Prior Publication Data

US 2006/0219802 A1 Oct. 5, 2006

(30) Foreign Application Priority Data

Mar. 29, 2005 (DE) ..... 10 2005 014 180

(51) Int. Cl.
*F02M 47/02* (2006.01)

(52) U.S. Cl. ..... 239/88; 239/96; 239/124; 239/533.2; 239/533.9; 239/126

(58) Field of Classification Search ..... 239/124, 239/125, 126, 127, 96, 585.1, 533.2, 533.3, 239/533.4, 533.5, 533.6, 533.7, 533.8, 533.9, 239/88

See application file for complete search history.

(56) References Cited

U.S. PATENT DOCUMENTS 4,798,186 A * 1/1989 Ganser ..... 123/467
5,042,718 A * 8/1991 Bergmann et al. ..... 239/88
5,094,215 A * 3/1992 Gustafson ..... 123/500
5,860,597 A * 1/1999 Tarr ..... 239/124
6,161,770 A * 12/2000 Sturman ..... 239/5
6,257,499 B1 * 7/2001 Sturman ..... 239/96
6,808,124 B2 * 10/2004 Egler ..... 239/88
6,848,630 B2 * 2/2005 Boecking ..... 239/96
6,892,955 B2 * 5/2005 Grabandt ..... 239/88
6,896,208 B2 * 5/2005 Kuegler ..... 239/533.4
6,908,040 B2 * 6/2005 Dong et al. ..... 239/5
6,953,157 B2 * 10/2005 Boehland et al. ..... 239/88
6,981,653 B2 * 1/2006 Boehland ..... 239/88
2003/0101968 A1 * 6/2003 Egler ..... 123/446
2004/0129804 A1 * 7/2004 Potz et al. ..... 239/533.2
2005/0087624 A1 * 4/2005 Neumaier ..... 239/533.2
2005/0194468 A1 * 9/2005 Brenk et al. ..... 239/533.3

* cited by examiner

*Primary Examiner*—Len Tran
*Assistant Examiner*—Trevor E McGraw
(74) *Attorney, Agent, or Firm*—Ronald E. Greigg

(57) ABSTRACT

A fuel injection system having one high-pressure fuel pump and one fuel injection valve, communicating with the high-pressure fuel pump, for each cylinder of an internal combustion engine. A pump work chamber is defined by a pump piston, and the fuel injection valve has an injection valve member by which at least one injection opening is controlled. An electrically actuated control valve controls a communication of the pump work chamber with a relief region and a movable control piston acts at least indirectly in the closing direction on the injection valve member, and the control piston, on its side remote from the at least one injection valve member, is acted upon at least indirectly by the pressure prevailing in the pump work chamber. The control piston, with its side toward the injection valve member, defines a control chamber. The communication with the relief region, controlled by the control valve, discharges into the control chamber, and the control chamber communicates at least indirectly with the pump work chamber via a throttled communication.

20 Claims, 4 Drawing Sheets

20
19
16
18
14
10
23
25
22
62
64
50
II
54
65
21
66
52
60
56
46
44
24
48
26
29
30
40
28
42
12
38
34
32
36

FUEL INJECTION SYSTEM FOR AN INTERNAL COMBUSTION ENGINE

CROSS-REFERENCE TO RELATED APPLICATIONS

This application is based on German Patent Application 10 2005 014 180.3 filed Mar. 29, 2005, upon which priority is claimed.

BACKGROUND OF THE INVENTION

1. Field of the Invention

The invention is directed to an improved fuel injection system for an internal combustion engine.

2. Description of the Prior Art

One fuel injection system known from German Patent Disclosure DE 101 19 984 A has one high-pressure fuel pump and one fuel injection valve, communicating with it, for each cylinder of the internal combustion engine. The high-pressure fuel pump has a pump piston, which is driven at least indirectly by the engine in a reciprocating motion and which defines a pump work chamber. The fuel injection valve has an injection valve member, by which at least one injection opening is controlled. The injection valve member is urged in an opening direction by the pressure prevailing in a pressure chamber communicating with the pump work chamber and is movable counter to a closing force in the opening direction for uncovering the at least one injection opening. An electrically actuated control valve is provided, by which a communication of the pump work chamber with a relief region is controlled at least indirectly. A movable control piston is furthermore provided, which acts at least indirectly on the injection valve member in the closing direction and which is acted upon, on its side remote from the injection valve member, by the pressure prevailing in the pump work chamber. The closing force on the injection valve member is generated by a closing spring, and the control piston acts on a support of the closing spring. In the pumping stroke of the pump piston, the control valve is closed at a defined instant, so that the pump work chamber is disconnected from the relief region, and high pressure builds up in the pump work chamber. In the pressure chamber, the same high pressure prevails as in the pump work chamber, and if a higher force on the injection valve member is exerted by this pressure than by the closing spring, then the injection valve member moves in the opening direction and uncovers the at least one injection opening, so that fuel is injected. Upon a further pressure increase in the pump work chamber, the control piston is displaced counter to the force of the closing spring, until it comes into contact with a stop, as a result of which the force exerted by the closing spring on the injection valve member is increased, and the injection valve member is moved into its closing position, thus ending the fuel injection. During the fuel injection, only a slight fuel quantity is injected in the form of a preinjection. After that, the pressure in the pump work chamber rises further, and when a greater pressure on the injection valve member is exerted by the pressure than by the closing spring, the injection valve member then moves in the opening direction again and uncovers the at least one injection opening, so that fuel is once again injected. During this fuel injection, a larger fuel quantity is injected as a main injection, to meet the demand of the engine. For terminating the main injection, the control valve is opened, so that the pump work chamber communicates with the relief region, and a high pressure no longer prevails in it; the injection valve member is moved in its closing direction by the closing spring, and the control piston returns to its outset position. The preinjection, and in particular its timing and the preinjection quantity, is defined structurally in this fuel injection system by the design of the control piston, its possible stroke, and the closing spring, so that the preinjection and the time interval until the next main injection, as well as the pressure at which the main injection begins, cannot be adapted flexibly as a function of various operating conditions of the engine. Another disadvantage of the known fuel injection system is that exact control of very slight fuel injection quantities is made more difficult. Moreover, closure of the fuel injection valve, or in other words a termination of the fuel injection, does not occur until at a low pressure in the pump work chamber, thus increasing the pollutant emissions from the engine. Moreover, the major pressure gradients that occur upon the opening and closure of the control valve cause a loud noise in the fuel injection system and considerable pressure fluctuations in the relief region.

OBJECT AND SUMMARY OF THE INVENTION

The fuel injection system of the invention has the advantage over the prior art that by means of the control piston, the instant and the fuel injection quantity of the preinjection can be controlled flexibly by means of the control valve. At the onset of a fuel injection, the control valve is closed in a known manner, so that high pressure builds up in the pump work chamber and in the pressure chamber, and the injection valve member opens, counter to the closing force, as a result of the pressure prevailing in the pressure chamber. The control piston is at least essentially in force equilibrium, so that it does not exert any force on the injection valve member. For terminating the preinjection, the control valve is opened again; the pressure in the pump work chamber and in the pressure chamber decreases only in delayed fashion, because of the throttle restriction in the communication, while the pressure in the control chamber drops rapidly because of the opened communication with the relief region, so that the injection valve member closes quickly in response to the force exerted on it in the closing direction by the control piston. Thus an elevated pressure is maintained in the pump work chamber and in the pressure chamber, and after that the control valve is closed again for a main injection, so that a new, fast pressure increase can take place in the pump work chamber and the pressure chamber, and the injection valve member opens again. The instant of the onset of the main injection and the pressure in the pump work chamber and the pressure chamber at which the main injection begins can be determined flexibly by the triggering of the control valve. For terminating the main injection, the control valve is opened again; the pressure in the pump work chamber and in the pressure chamber drops again only in delayed fashion, so that the fuel injection valve closes at a high pressure in the pump work chamber and in the pressure chamber, and as a result the pollutant emissions from the engine are reduced. Because of the delayed pressure reduction in the pump work chamber and the pressure chamber, only slight pressure gradients also ensue, so that the noise of the fuel injection system is reduced, and only slight pressure fluctuations are brought about in the relief region. Finally, even very brief interruptions in the fuel injection and thus very slight fuel injection quantities can also be controlled.

Advantageous features and refinements of the fuel injection system of the invention are disclosed. One embodiment makes an at least indirect communication, which is easily produced, of the control chamber with the pump work chamber possible, while other embodiments assure that the control piston is not moved along with the pump piston in the intake stroke of the pump piston. One embodiment enables adapting the pressure conditions on both sides of the control piston and thus the force exerted by the control piston onto the injection valve member.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
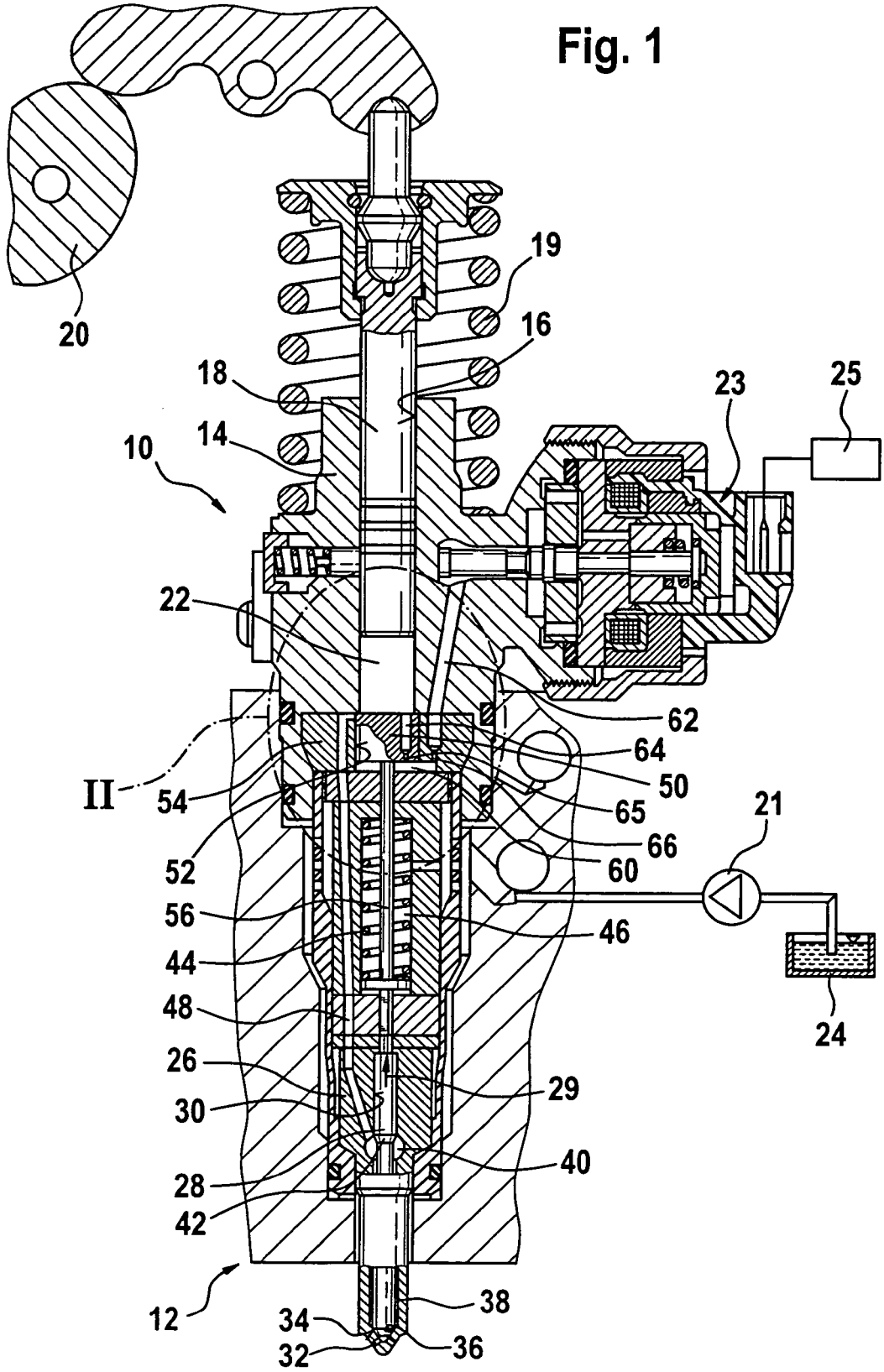
FIG. 1 is a simplified illustration of a fuel injection system for an internal combustion engine in a first exemplary embodiment of the invention.

In FIG. 1, a fuel injection system for an internal combustion engine is shown in a first exemplary embodiment. For each cylinder of the engine, the fuel injection system has one high-pressure fuel pump 10 and one fuel injection valve 12 communicating with it. The high-pressure fuel pump 10 and the fuel injection valve 12 can be combined into a unit, which is also known as a unit fuel injector. The high-pressure fuel pump 10 and the fuel injection valve 12 may, however, also be embodied as structural component units, which communicate with one another via a fuel line.

The high-pressure fuel pump 10 has a pump body 14, in which, in a cylinder bore 16, a pump piston 18 is tightly guided, which piston is driven in a reciprocating motion, counter to the force of a restoring spring 19, by a cam 20 of a camshaft of the engine. The pressure course in the pump work chamber 22 in the pumping stroke of the pump piston 18 is determined by the profile of the cam 20. The pump work chamber 22 has a communication with a relief region, and this communication is controlled by an electrically actuated control valve 23. Thus the fuel injection is controlled by the control valve 23, which can have an electromagnetic or piezoelectric actuator. The control valve 23 is triggered by an electronic control unit 25. The relief region is for instance a low-pressure region, in which an elevated pressure is generated by a feed pump 21 in order to enable filling of the pump work chamber 22 in the intake stroke of the pump piston 18. The feed pump 21 aspirates fuel from a fuel tank 24.

The fuel injection valve 12 has a valve body 26, which may be embodied in multiple parts and which is connected to the pump body 14. In the valve body 26, an injection valve member 28 is guided longitudinally displaceably in a bore 30. The bore 30 extends at least approximately parallel to the cylinder 16 of the pump body 14, but can also extend at an incline to it. The valve body 26, in its end region oriented toward the combustion chamber of the engine cylinder, has at least one and preferably a plurality of injection openings 32. In its end region toward the combustion chamber, the injection valve member 28 has a sealing face 34, which is for instance approximately conical, and which cooperates with a valve seat 36, for instance likewise approximately conical, that is embodied in the valve body 26, in its end region toward the combustion chamber, and from which or downstream of which valve seat the injection openings 32 lead away.

In the valve body 26, between the injection valve member 28 and the bore 30 toward the valve seat 36, there is an annular chamber 38, which changes over, in its end region toward the valve seat 36, by means of a radial enlargement of the bore 30 into a pressure chamber 40 surrounding the injection valve member 28. At the level of the pressure chamber 40, as a result of a cross-sectional reduction, the injection valve member 28 has a pressure shoulder 42 pointing toward the valve seat 36. The end of the injection valve member 28 remote from the combustion chamber is engaged by a prestressed closing spring 44, by which the injection valve member 28 is pressed toward the valve seat 36. The closing spring 44 is located in a spring chamber 46, embodied by a bore, of a spring retainer body, which forms part of the valve body 26 and adjoins the bore 30. The pressure chamber 40 has a communication 48, extending through the valve body 26 and the pump body 14, with the pump work chamber 22. The communication 48 is formed for instance by bores provided in the valve body 26 and in the pump body 14.

Figure 2:
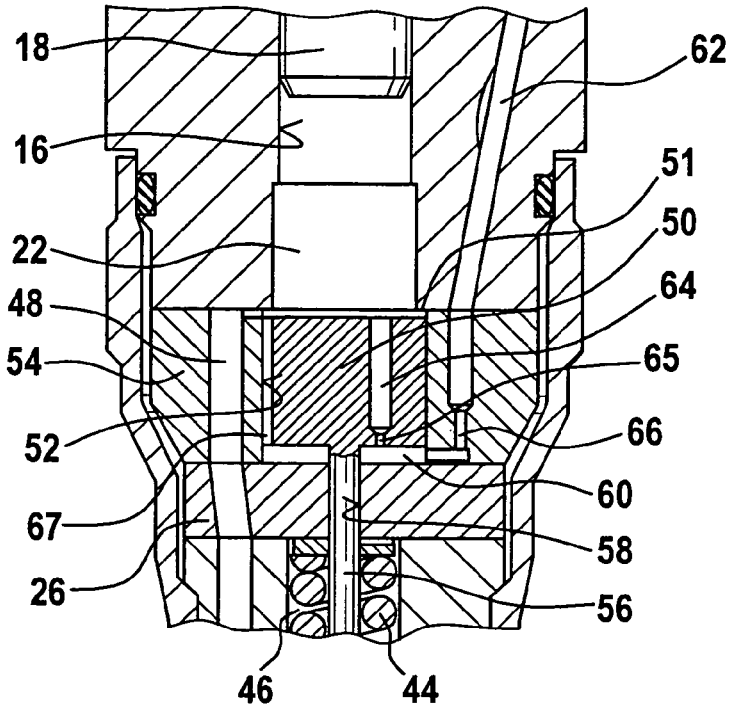
FIG. 2 is an enlargement of the detail II in FIG. 1 of the fuel injection system of the first exemplary embodiment.

In FIGS. 1 and 2, the fuel injection system is shown in a first exemplary embodiment, in which, between the pump work chamber 22 and the spring chamber 46, there is a control piston 50, which is guided displaceably in a bore 52 of an intermediate body 54 located between the valve body 26 and the pump body 14. The bore 52 extends at least approximately coaxially to the bore 30 and to the cylinder bore 16. Via a push rod 56, the control piston 50 acts on the injection valve member 28 in its closing direction. The push rod 56 may be embodied integrally with the control piston 50 or with the injection valve member 28, or alternatively can be connected as a separate part to the control piston 50 or the injection valve member 28 or fastened as a separate part between the control piston 50 and the injection valve member 28. The push rod 56 extends through the spring chamber 46 and is guided tightly in a bore 58 in the intermediate body 54. The diameter of the push rod 56 is substantially less than the diameter of the control piston 50. The stroke of the control piston 50 toward the pump work chamber 22 is limited by a stop 51. The stop 51 may be formed for instance by an annular shoulder on the pump body 14, which is formed as a result of the fact that the cylinder bore 16 has a smaller diameter than the bore 52 in which the control piston 50 is disposed.

The control piston 50, on its face end toward the pump work chamber 22, is acted upon by the pressure prevailing in the pump work chamber 22. It can be provided that the pump work chamber 22 is defined by the face end of the control piston 50. With its face end toward the injection valve member 28, the control piston 50 defines a control chamber 60 in the bore 52. The communication 62 with the relief region, which is controlled by the control valve 23, discharges into the control chamber 60. The communication 62 is formed for instance by bores extending in the intermediate body 54 and in the pump body 14. There is at least one opening, for instance in the form of a through bore 64, in the control piston 50, through which opening the control chamber 60 communicates with the pump work chamber 22. A throttle restriction 65 is provided in the opening 64. A throttle restriction 66 can preferably also be provided in the communication 62, controlled by the control valve 23, of the control chamber 60 with the relief region. Alternatively, the opening in the control piston 50 can also be formed by at least one recess located on its circumference, in which recess the throttle restriction 65 is provided. It is also possible for a plurality of recesses 67 to be provided, distributed over the circumference of the control piston 50. The at least one recess 67 may also be disposed in the circumference of the bore 52, rather than in the control piston 50.

The function of the fuel injection system in accordance with the first exemplary embodiment will now be explained.

Upon the intake stroke of the pump piston 18, in which the pump piston moves out of the cylinder bore 16 by the action of the restoring spring 19, the control valve 23 is opened, so that the fuel pumped by the feed pump 21 flows through the communication 62 into the control chamber 60 and out of it via the opening 64 into the pump work chamber 22. The stop 51 assures that the control piston 50 will not be moved with the pump piston 18 past the intake stroke of the pump piston. In its pumping stroke, the pump piston 18, acted upon by the cam 20, moves counter to the force of the restoring spring 19 into the cylinder bore 16; at the onset of the pumping stroke, the control valve 23 can still be opened. By means of the pump piston 18, fuel is positively displaced out of the pump work chamber 22 back into the relief region again, and because of the throttle restriction, located in the opening 64, an elevated pressure is established in the pump work chamber 22 and in the pressure chamber 40, and because of the throttle restriction 66 in the communication 62, an elevated pressure is also established in the control chamber. Because of the throttling at the throttle restriction 65 and the resultant pressure drop in the control chamber 60, the control piston 50 is kept in contact with the injection valve member 28 through push rod 56, and by means of the injection valve member a slight pressure on the injection valve member 28 in the closing direction is generated. The throttle restriction 66 in the communication 62 can also be omitted, in which case the control valve 23 preferably uncovers only a small flow cross section toward the relief region, which cross section effectively forms the throttle restriction. The control valve 23 has a control valve member, which upon the switchover of the control valve 23 preferably executes only a short stroke, so that the switchover can be very fast.

By means of the control unit 25, as a function of such engine operating parameters as its rpm and load, the control valve 23 is closed at a defined instant, so that fuel can no longer flow out into the relief region. By means of the pump piston 18, high pressure is then generated in the pump work chamber 22, the pressure chamber 40, and the control chamber 60. In the control chamber 60, at least essentially the same high pressure then prevails as in the pump work chamber 22, so that by means of the control piston 50, at least essentially no force is generated in the closing direction on the injection valve member 28. The injection valve member 28, and with it the control piston 50, moves in the opening direction 29 and uncovers the at least one injection opening 32, when the force, generated via the pressure shoulder 42 by the high pressure prevailing in the pressure chamber 40, is greater than the force of the closing spring 44. With the injection valve member 28 open as well, the communication 48 of the pressure chamber 40 with the pump work chamber 22 is not closed by the control piston 50 but instead remains open. In a preinjection, the injection valve member 28 is opened for only a brief time and for the injection of a small fuel quantity. For terminating the preinjection, the control valve 23 is opened by the control unit 25, so that the communication 62 with the relief region is opened. The fuel quantity injected in the preinjection is defined by the duration of the preinjection. The pressure in the control chamber 60 drops faster than the pressure in the pump work chamber 22 and in the pressure chamber 40, so that by means of the control piston 50, a force in the closing direction on the injection valve member 28 is generated, by which the injection valve member 28 is moved into its closing position. The pressure drop in the pump work chamber 22 and in the pressure chamber 40, which is delayed relative to the control chamber 60 when the control valve 23 is open, is brought about by the throttle restriction 65 in the opening 64. Because of the throttle restriction 65, the pressure in the pump work chamber 22 and in the pressure chamber 40 remains markedly higher than the pressure in the relief region. Even with the injection valve member 28 closed and the control piston 50 resting on it, the opening of the communication 62 into the control chamber 60 is not closed by the control piston 50 but instead remains open.

If an ensuing main injection is to begin, the control valve 23 is closed again by the control unit 25, so that the pressure in the control chamber 60 rises again, and at least essentially no force in the closing direction is exerted by the control piston 50 on the injection valve member 28 any longer. The injection valve member 28 then opens again as a result of the high pressure prevailing in the pressure chamber 40 and uncovers the at least one injection opening 32. As a consequence of the elevated pressure obtained in the pump work chamber 22 and in the pressure chamber 40, a faster high-pressure buildup for the main injection ensues after the closure of the control valve 23. The instant of the onset of the main injection and the pressure in the pressure chamber 40 at which the main injection begins can be determined flexibly by the control unit 25 as a function of operating parameters. For terminating the main injection, the control valve 23 is opened again by the control unit 25, and the fuel quantity injected in the main injection is defined by the duration of closure of the control valve 23. Upon the termination of the main injection as well, an elevated pressure is still obtained in the pump work chamber 22, by which the closure of the injection valve member 28 via the control piston 50 is reinforced. In the relief region, only relatively slight pressure fluctuations are brought about, because of the elevated pressure obtained in the pump work chamber 22, even when the control valve 23 is open, as a consequence of the control piston 50. The pressure gradient, or in other words the pressure change, in the pump work chamber 22 after the opening and closure of the control valve 23 is also reduced because of the control piston 50, as a result of which the load the engine for the pump piston 18 is reduced. After the main injection, a postinjection of fuel can also be made, to which end the control valve 23 is closed again by the control unit 25.

Figure 3:
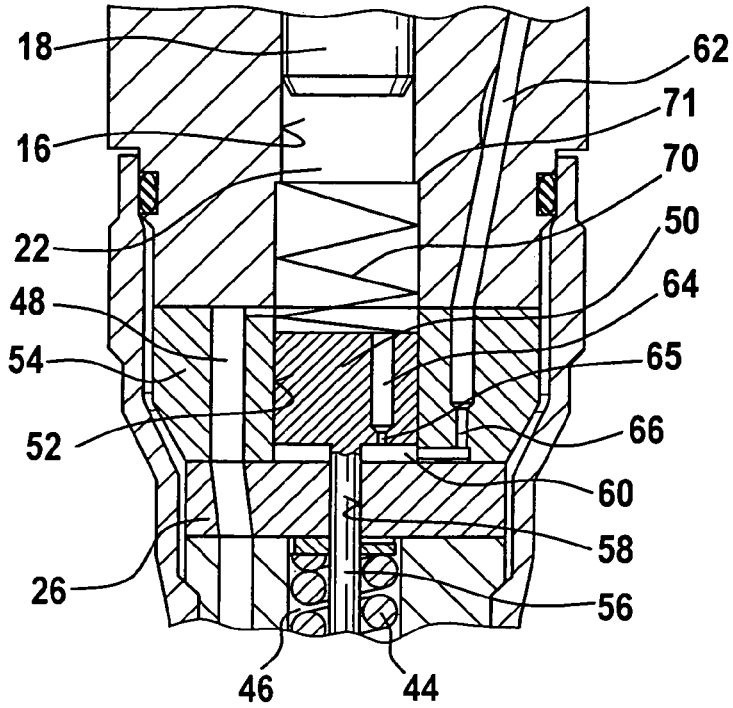
FIGS. 3 through 6 show the detail II of the fuel injection system in further exemplary embodiments.

In FIG. 3, the detail II of the fuel injection system is shown in a second exemplary embodiment, in which the essential construction is the same as in the first exemplary embodiment. In the second exemplary embodiment, the control piston 50 is pressed toward the injection valve member 28 by a spring 70. The stop 51 provided in the first exemplary embodiment can be omitted, since the spring 70 prevents the control piston 50 from moving with the pump piston 18 in the intake stroke of the pump piston. The spring 70 may for instance be a helical compression spring, whose diameter is approximately equal to the diameter of the control piston 50. The spring 70 is braced on one end on an annular shoulder 71, which can be formed by a reduction in the diameter of the cylinder bore 16, and is braced on its other end on the face end, toward the pump work chamber 22, of the control piston 50.

Figure 4:
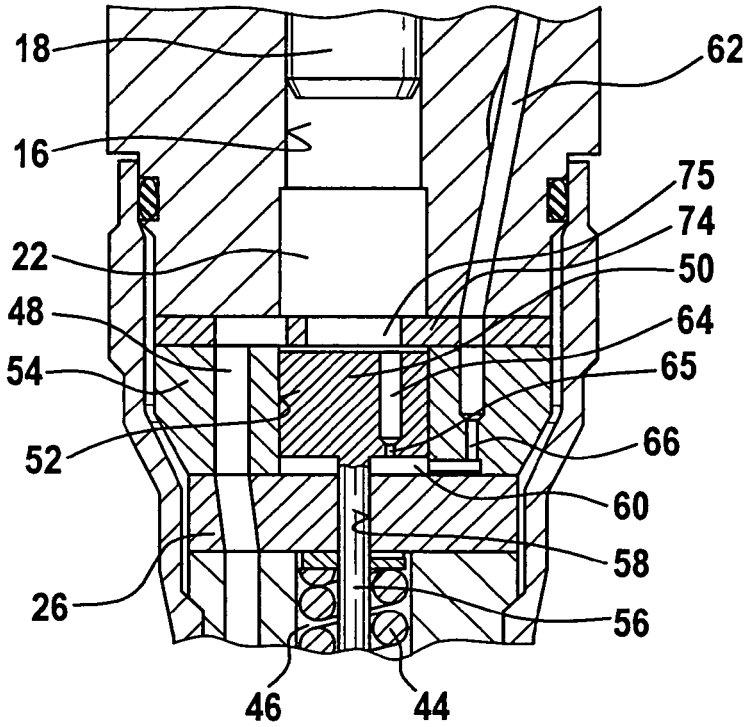

In FIG. 4, the detail II of the fuel injection system is shown in a third exemplary embodiment, in which the essential structure is again the same as in the first exemplary embodiment. In the third exemplary embodiment, an intermediate disk 74 is also provided between the pump body 14 and the intermediate body 54, and in the region of the control piston 50 this disk has an opening 75, which is smaller than the diameter of the control piston 50; as a result, the intermediate disk 74 forms a stop for limiting the stroke of the control piston 50 toward the pump work chamber 22, and the stop 51 provided in the first exemplary embodiment can be omitted.

Figure 5:
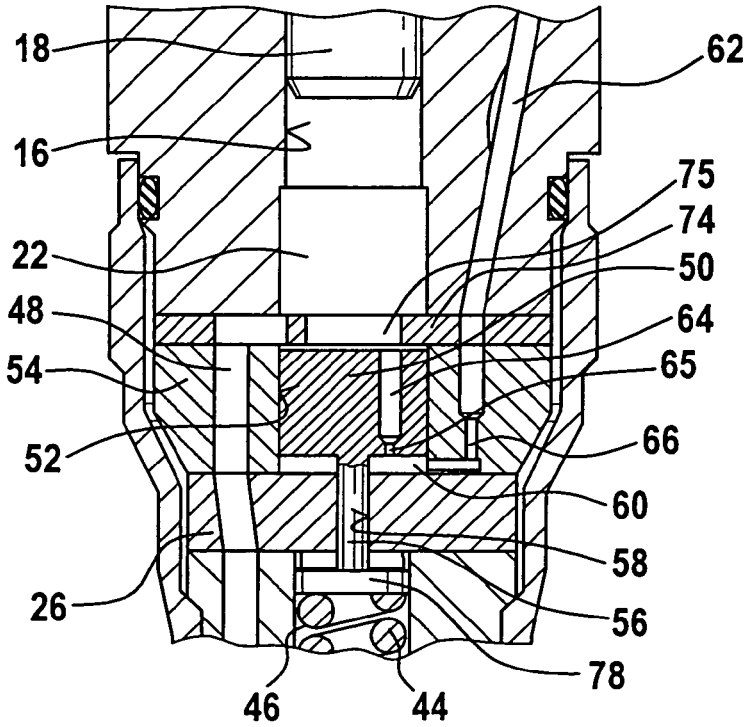

In FIG. 5, the detail II of the fuel injection system is shown in a fourth exemplary embodiment, in which the essential structure is the same as in one of the exemplary embodiments described above. The control piston 50 in the fourth exemplary embodiment is not braced directly on the injection valve member 28, however, but rather on a spring support, for instance in the form of a spring plate 78, on which the closing spring 44 acting on the injection valve member 28 is also braced. When a greater pressure is exerted on the control piston 50 by the pressure prevailing in the pump work chamber 22 than by the pressure prevailing in the control chamber 60, the control piston 50 is moved along with the spring plate 78 toward the injection valve member 28, and as a result the prestressing of the closing spring 44 and hence the force acting on the injection valve member 28 in the closing direction are increased. The spring chamber 46 is fuel-filled, and the pressure ratios can be influenced by means of a communication, having a throttle restriction, of the spring chamber 46 with a relief region, in such a way that the motion of the spring plate 78 and of the control piston 50, and hence the increase in the prestressing of the closing spring 44, can be varied. It is thus possible to adapt the opening and closing pressure performance graphs of the fuel injection valve 12.

Figure 6:
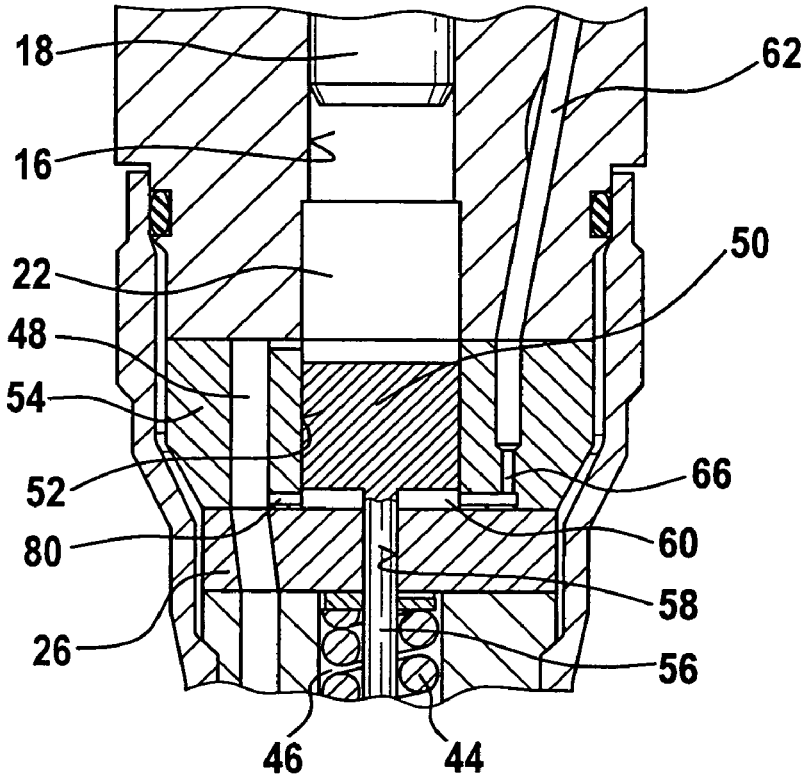

In FIG. 6, the detail II of the fuel injection system is shown in a fifth exemplary embodiment, in which the essential structure is the same as in one of the exemplary embodiments described above. In a departure from the exemplary embodiments described above, however, the control chamber 50 in the fifth exemplary embodiment does not communicate directly with the pump work chamber 22 but instead, via an opening 80, with the communication 48 between the pump work chamber 22 and the pressure chamber 40 and thus indirectly communicates with the pump work chamber 22. The opening 80 may be formed by a bore in the intermediate body 54. Alternatively, the opening 80 may also be formed by a groove in the intermediate body 54 or in the valve body 26, and the groove is made in a face end of the intermediate body 54 or of the valve body 26 that faces toward the face end of the other part, that is, the valve body 26 or intermediate body 54, respectively.

The foregoing relates to preferred exemplary embodiments of the invention, it being understood that other variants and embodiments thereof are possible within the spirit and scope of the invention, the latter being defined by the appended claims.

We claim:

1. In a fuel injection system for an internal combustion engine, having one high-pressure fuel pump and one fuel injection valve, communicating with the high pressure pump for each cylinder of the engine, in which the high-pressure fuel pump has a pump piston driven at least indirectly by the engine in a reciprocating motion and defining a pump work chamber, and the fuel injection valve has at least one injection valve member by which at least one injection opening is controlled and which is urged in an opening direction by the pressure prevailing in a pressure chamber of the fuel injection valve communicating with the pump work chamber and is movable counter to a closing force in the opening direction for uncovering the at least one injection opening, having an electrically actuated control valve, by which a communication of the pump work chamber with a relief region is controlled at least indirectly, and a movable control piston which acts at least indirectly on the at least one injection valve member in the closing direction, and the control piston, on its side remote from the at least one injection valve member, being acted upon at least indirectly by the pressure prevailing in the pump work chamber, the improvement wherein the control piston, with its side to ward the at least one injection valve member, defines a control chamber and, the control piston with its side toward the pump piston, defines the pump work chamber; wherein the communication with the relief region, controlled by the control valve, discharges into the control chamber; wherein the control chamber communicates at least indirectly with the pump work chamber via a throttled communication; and wherein the control valve of the fuel injection system has only one control valve.

2. The fuel injection system as defined by claim 1, wherein the throttled communication of the control chamber with the pump work chamber comprises at least one opening in the control piston, and a throttle restriction is disposed in the at least one opening.

3. The fuel injection system as defined by claim 1, wherein the throttled communication of the control chamber with the pump work chamber comprises at least one recess on the circumference of the control piston, and a throttle restriction disposed in the at least one recess.

4. The fuel injection system as defined by claim 1, wherein the control chamber communicates with the communication between the pump work chamber and the pressure chamber via the throttled communication.

5. The fuel injection system as defined by claim 1, further comprising a stop limiting the stroke of the control piston in a direction pointing away from the at least one injection valve member.

6. The fuel injection system as defined by claim 2, further comprising a stop limiting the stroke of the control piston in a direction pointing away from the at least one injection valve member.

7. The fuel injection system as defined by claim 3, further comprising a stop limiting the stroke of the control piston in a direction pointing away from the at least one injection valve member.

8. The fuel injection system as defined by claim 4, further comprising a stop limiting the stroke of the control piston in a direction pointing away from the at least one injection valve member.

9. The fuel injection system as defined by claim 1, further comprising a spring urging the control piston toward the at least one injection valve member.

10. The fuel injection system as defined by claim 2, further comprising a spring urging the control piston toward the at least one injection valve member.

11. The fuel injection system as defined by claim 3, further comprising a spring urging the control piston toward the at least one injection valve member.

12. The fuel injection system as defined by claim 4, further comprising a spring urging the control piston toward the at least one injection valve member.

13. The fuel injection system as defined by claim 5, further comprising a spring urging the control piston toward the at least one injection valve member.

14. The fuel injection system as defined by claim 1, further comprising a throttle restriction disposed in the communication with the relief region between the control chamber and the control valve.

15. The fuel injection system as defined by claim 2, further comprising a throttle restriction disposed in the communication with the relief region between the control chamber and the control valve.

16. The fuel injection system as defined by claim 1, further comprising a push rod bracing the control piston at least indirectly on the at least one injection valve member.

17. The fuel injection system as defined by claim 3, further comprising a push rod bracing the control piston at least indirectly on the at least one injection valve member.

18. The fuel injection system as defined by claim 1, further comprising a closing spring generating the closing force on the at least one injection valve member, and wherein the control piston acts at least indirectly on a support of the closing spring.

19. The fuel injection system as defined by claim 4, further comprising a closing spring generating the closing force on the at least one injection valve member, and wherein the control piston acts at least indirectly on a support of the closing spring.

20. The fuel injection system as defined by claim 1, wherein the control piston is disposed between the at least one injection valve member and the pump work chamber.

* * * * *